US010714862B1

(12) United States Patent
Yu

(10) Patent No.: US 10,714,862 B1
(45) Date of Patent: Jul. 14, 2020

(54) ELECTRICAL SOCKET

(71) Applicant: NINGBO WELL ELECTRIC APPLIANCE CO., LTD., Ningbo (CN)

(72) Inventor: Guolin Yu, Ningbo (CN)

(73) Assignee: NINGBO WELL ELECTRIC APPLIANCE CO., LTD., Ningbo (CN)

( * ) Notice: Subject to any disclaimer, the term of this patent is extended or adjusted under 35 U.S.C. 154(b) by 0 days.

(21) Appl. No.: 16/425,949

(22) Filed: May 30, 2019

(30) Foreign Application Priority Data

Mar. 27, 2019 (CN) ..... 2019 1 0239299
Mar. 27, 2019 (CN) ..... 2019 2 0404642

(51) Int. Cl.
*H01R 13/447* (2006.01)
*H01R 13/717* (2006.01)

(52) U.S. Cl.
CPC ..... *H01R 13/447* (2013.01); *H01R 13/717* (2013.01)

(58) Field of Classification Search
CPC .. H01R 13/447; H01R 13/639; H01R 13/717; H01R 13/20; H01R 13/6392
See application file for complete search history.

(56) References Cited

U.S. PATENT DOCUMENTS 3,891,289 A * 6/1975 Hanke ..... H01R 13/20 439/106
4,867,697 A * 9/1989 Borges ..... H01R 13/193 439/265
5,921,798 A * 7/1999 Ursich ..... H01R 13/6276 439/346
6,875,040 B1 * 4/2005 O'Keefe ..... H01R 13/6392 439/346
7,114,979 B1 * 10/2006 Lai ..... H01R 13/20 439/346
7,232,349 B1 * 6/2007 Chen ..... H01R 13/6392 439/810
7,320,613 B1 * 1/2008 Ratzlaff ..... H01R 13/6397 439/345
7,347,708 B1 * 3/2008 Huang ..... H01R 13/639 439/263
7,452,230 B1 * 11/2008 Miller ..... H01R 13/6392 439/270
2014/0057477 A1 * 2/2014 Raptis ..... H01R 13/639 439/346
2016/0322747 A1 * 11/2016 Jian ..... H01R 13/639

* cited by examiner

*Primary Examiner* — Oscar C Jimenez

(57) ABSTRACT

The present disclosure discloses an electrical socket having a housing and at least two electrodes disposed in the housing. Each of the two electrodes is respectively provided with a through hole. An elastic buckle is disposed in the housing and comprises two elastic pieces disposed oppositely, wherein each of the two elastic pieces is respectively provided with a first peg corresponding to the through hole. A slider is provided in the housing, a part of the slider extends into the housing and between the two elastic pieces of the elastic buckle, and the slider is configured for pushing the two elastic pieces of the elastic buckle and driving the first peg to insert into the through hole for limiting pins, which is inserted in the electrodes.

11 Claims, 8 Drawing Sheets

ELECTRICAL SOCKET

CROSS-REFERENCE TO RELATED APPLICATIONS

This application claims all benefits accruing under 35 U.S.C. § 119 from China Patent Application Nos. 201910239299.9, filed on Mar. 27, 2019, and 201920404642.6, filed on Mar. 27, 2019, in the State Intellectual Property Office of China, the content of which is hereby incorporated by reference.

TECHNICAL FIELD

The present disclosure relates to an electrical socket.

BACKGROUND

An electrical socket, also known as a power outlet or a switch socket, includes at least one output for receiving an electrical plug. Various wirings will be plugged into the electrical socket and connect to other circuits.

When the electrical socket and the electrical plug are mated, the electrical socket may have a locking function to prevent the electrical plug from detaching from the electrical socket. For example, pins of the electrical plug may insert into electrodes of the electrical socket and the electrodes press upon the pins to hold them to prevent the electrical plug from detaching from the electrical socket.

When the pins of the electrical plug are clamped by the electrodes, static friction is formed between the pins and the electrodes. Because the electrodes and the pins are both made of a metal material, the friction coefficient between the electrodes and the pins is small, so that it is hard to lock the pins over time. Furthermore, after the electrical socket has been used for a long time, the electrodes may be prone to wear out, thereby further reducing the locking effect of the electrical socket.

SUMMARY

In order to provide an electrical socket with a good locking feature, an embodiment of the present disclosure includes an electrical socket having a housing and at least two electrodes disposed in the housing. Each of the at least two electrodes is respectively provided with a through hole. An elastic buckle is disposed in the housing and includes two elastic pieces disposed oppositely, wherein each of the two elastic pieces is respectively provided with a first peg corresponding to the through hole. A slider is provided in the housing. A part of the slider extends into the housing between the two elastic pieces of the elastic buckle. The slider is configured for pushing the two elastic pieces of the elastic buckle and driving the first peg to insert into the through hole for restricting movement of the pins.

Furthermore, the electrical socket further includes a first cover plate mounted on the housing.

Furthermore, the slider includes a pushing plate disposed on the first cover plate and a pushing pillar vertically connected with the pushing plate. An end of the pushing pillar away from the first cover plate extends into the housing between the two elastic pieces of the elastic buckle.

Furthermore, a limiting portion is disposed on each of opposite sides of the pushing pillar, and each of the two elastic pieces is provided with a limiting mating portion. When pushing the slider, the pushing pillar pushes the two elastic pieces and the limiting portion abuts the limiting mating portion resulting in increasing the distance between ends of the elastic pieces and moving the first peg into the through hole.

Furthermore, the limiting portion includes a concave surface, and the limiting mating portion includes a convex surface for engaging with the concave surface of the limiting portion.

Furthermore, each of the two elastic pieces is further respectively provided with a second peg, the pushing pillar is provided with two bending plates disposed on opposite sides of the pushing pillar. When returning the slider, the limiting portion moves away from the limiting mating portion and the two bending plates abuts the second peg, resulting in driving the elastic pieces to return, the first peg to move out of the through hole of the pins so that the electrical plug can be released.

Furthermore, each of the two bending plates includes a cambered surface, the second peg includes a mating surface matching with the cambered surface, when returning the slider, the mating surface of the second peg abuts the cambered surface of the two bending plates, resulting in that the elastic pieces return.

Furthermore, the first cover plate includes a slot, a part of the pushing pillar extends through the slot and is able to slide along the slot, the two bending plates is under and abuts the first cover plate.

Furthermore, the pushing plate is provided with a sliding limit element on a surface facing to the first cover plate, and the first cover plate is provided with a sliding mating element matched with the sliding limit element to ensure the pushing plate slidably couples with the first cover plate.

Furthermore, the sliding limit element is concave and the sliding mating element is a protrusion.

Furthermore, the sliding mating element is concave and the sliding limit element is a protrusion.

Furthermore, a size of a part of the pushing pillar closer to the ends of the elastic pieces is larger than a size of the other part of the pushing pillar away from the ends of the elastic pieces.

Furthermore, the electrical socket further includes a power light electrically connected with the electrodes and disposed in the housing.

Furthermore, the first peg is made of plastic.

The electrical socket of the present embodiment has following advantages. The pins of the electrical plug can insert into the electrical socket. When the electrical plug needs to be locked, the slider is pushed and the first peg of the elastic buckle will insert through the through holes of electrodes and the locking holes of the pins. So that the electrical plug can be stably locked by the electrical socket. The operation thereof is simple and the electrical plug is not easily detached from the electrical socket.

DETAILED DESCRIPTION

The present disclosure will be further described in detail below with reference to the drawings and specific embodiments, in order to better understand the objective, the technical solution and the advantage of the present disclosure. It should be understood that the specific embodiments described herein are merely illustrative and are not intended to limit the scope of the disclosure.

It should be noted that when an element is referred to as being "fixed" to another element, it may be directly attached to the other element or a further element may be presented between them. When an element is considered to be "connected" to another element, it may be directly connected to the other element or connected to the other element through a further element (e.g., indirectly connected). The terms as used herein "vertical", "horizontal", "left", "right", and the like, are for illustrative purposes only and are not meant to be the only orientation.

Unless otherwise defined, all technical and scientific terms used herein have the same meaning as a skilled person in the art would understand. The terminology used in the description of the present disclosure is for the purpose of describing particular embodiments and is not intended to limit the disclosure.

Figure 1:
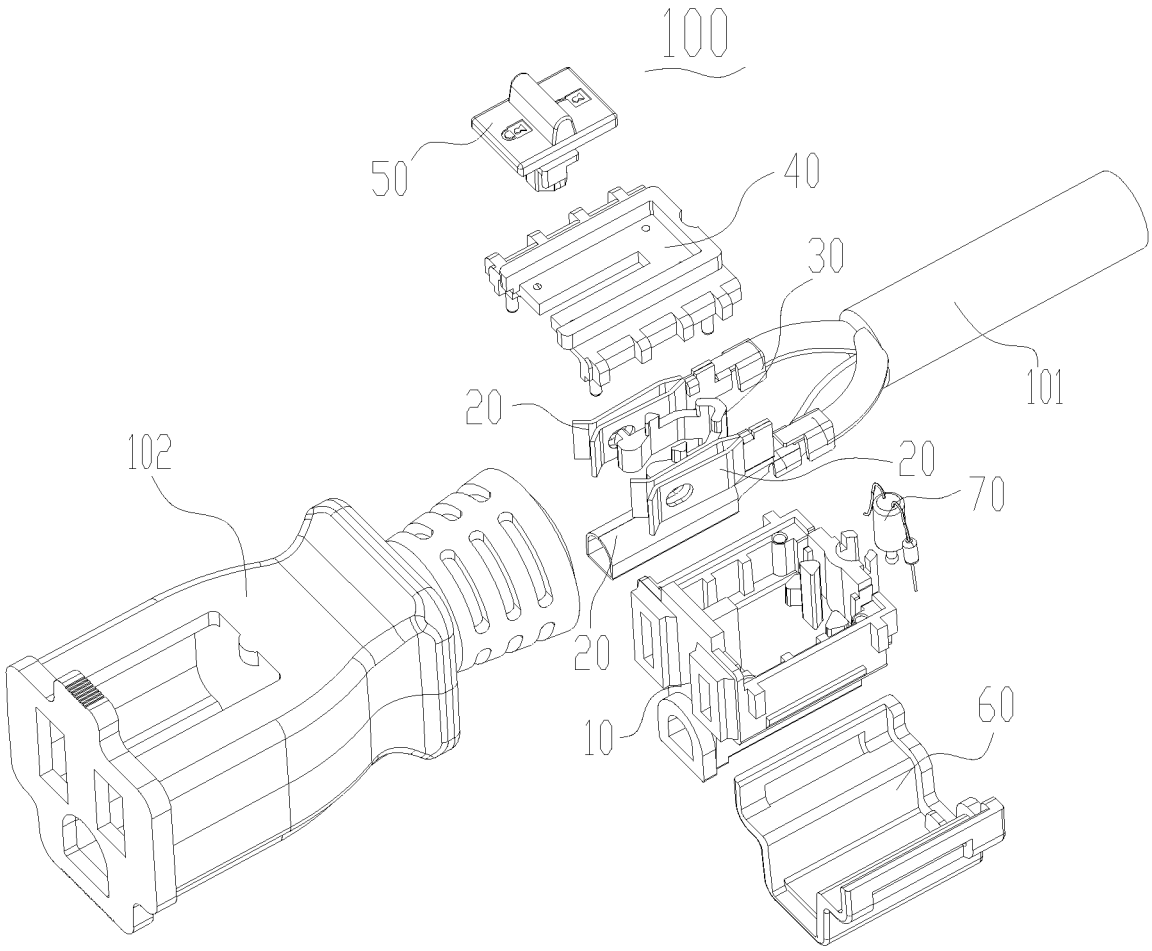
FIG. 1 is an exploded view of an electrical socket according to an embodiment of the present disclosure.
Figure 8:
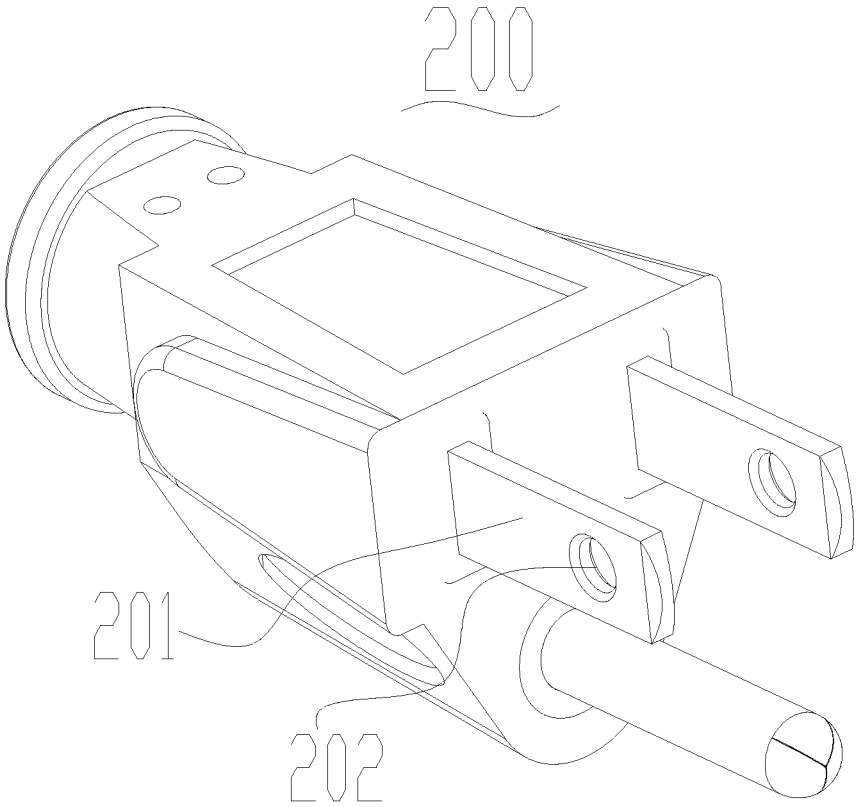
FIG. 8 is a perspective view of an electrical plug mated with the electrical socket of FIG. 1.

Referring to FIGS. 1 and 8, an embodiment of the present disclosure includes an electrical socket 100, which is mated with an electrical plug 200 having three pins 201. Two of the three pins 201 are electrically connected with power cords. Each of the two of the three pins 201 includes a locking hole 202.

Figure 2:
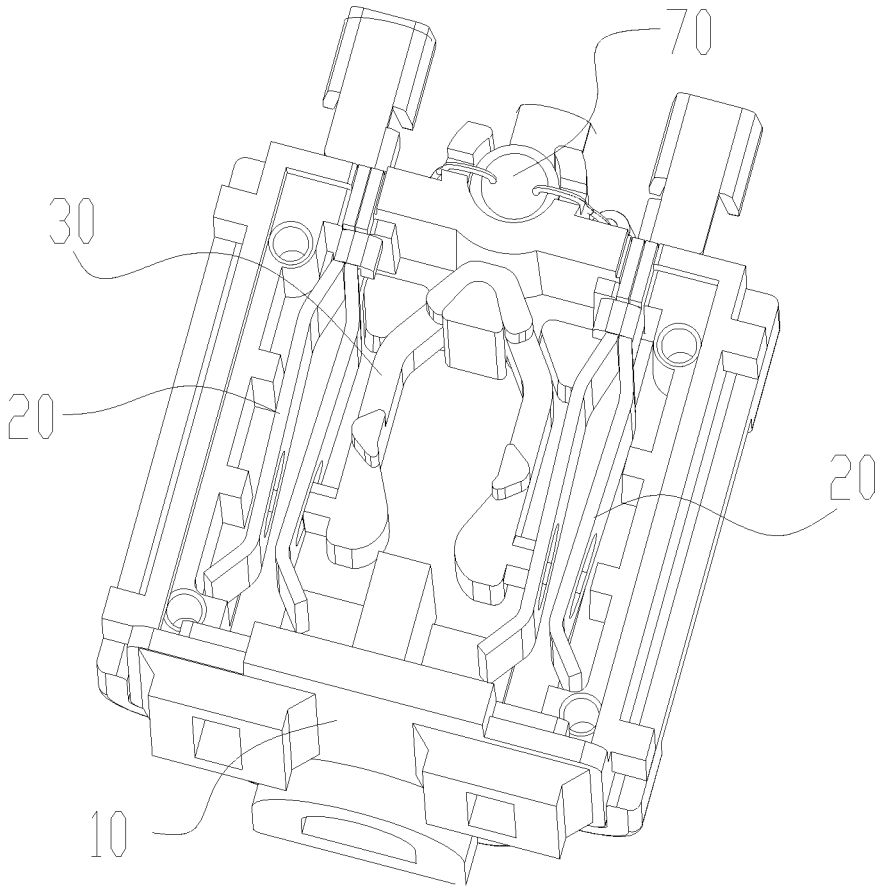
FIG. 2 is a perspective view of a housing, electrodes, an elastic buckle, and a power light of the electrical socket of FIG. 1.

Referring to FIGS. 1 and 2, the electrical socket 100 includes a housing 10 and at least two electrodes 20 disposed in the housing 10 and connected with a power cord 101. The electrical socket 100 further includes an elastic buckle 30 disposed in the housing 10 and a slider 50 provided and slidable in the housing 10.

In this embodiment, the housing 10 has a cavity. The elastic buckle 30 and parts of the two electrodes 20 connected with the pins 201 are located in the cavity of the housing 10. The housing 10 can include a first cover plate 40 configured for covering the cavity. The slider 50 can be slidably disposed on the first cover plate 40 and partially protrudes into the cavity of the housing 10.

Figure 3:
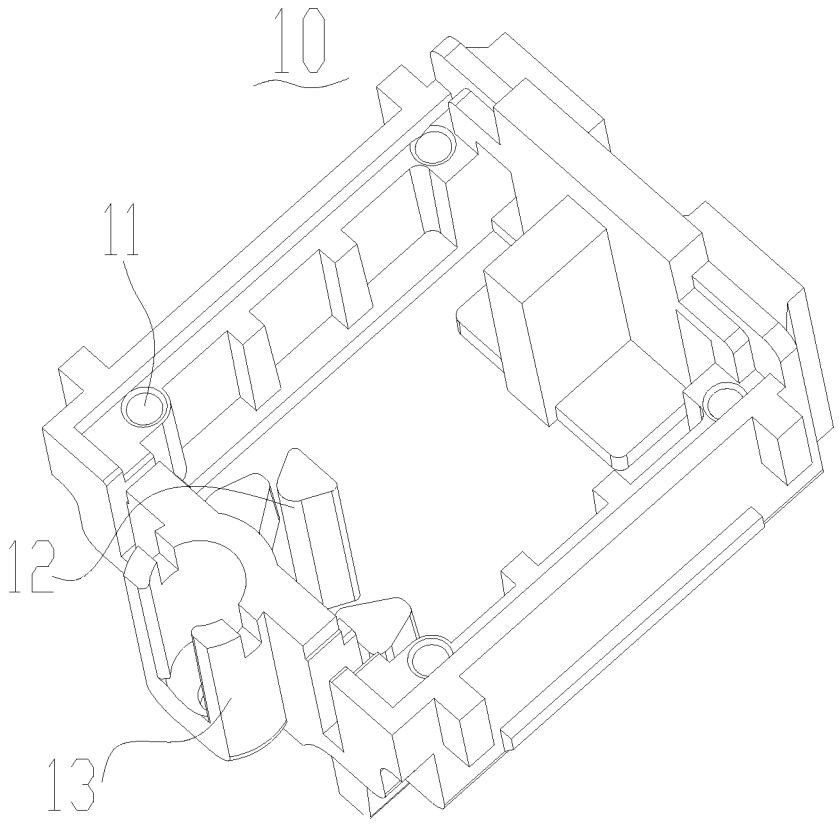
FIG. 3 is another perspective view of the housing of the electrical socket of FIG. 1.
Figure 6:
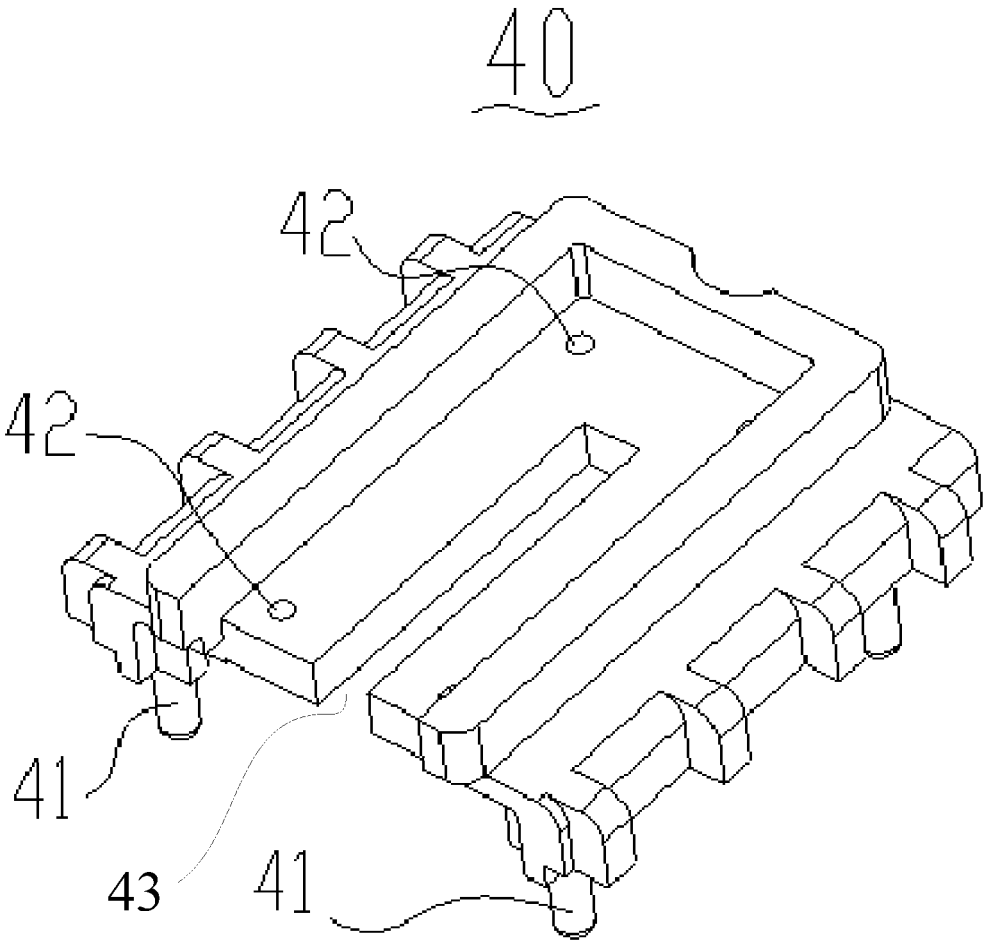
FIG. 6 is a perspective view of a first cover plate of the electrical socket of FIG. 1.

Referring to FIGS. 3 and 6, four assembly holes 11 are defined in four corners of the housing 10. The first cover plate 40 includes four assembly pillars 41 matching with the four assembly holes 11 respectively. When the first cover plate 40 is assembled on the housing 10, the assembly pillars 41 will correspondingly insert into the assembly holes 11 of the housing 10, thereby realizing limit assembly between the first cover plate 40 and the housing 10.

Figure 5:
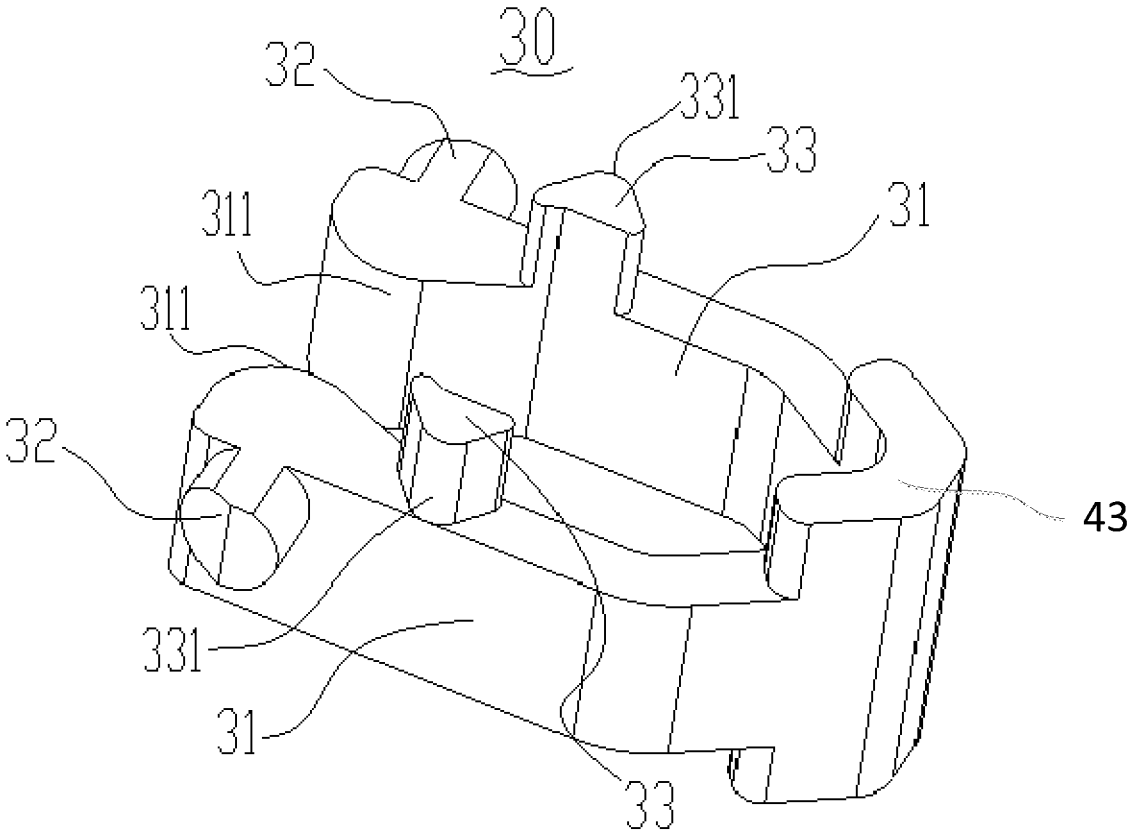
FIG. 5 is another perspective view of the elastic buckle of the electrical socket of FIG. 1.

Referring to FIGS. 2 and 5, the housing 10 is further provided with three limiting pillars 12 separated from each other. The elastic buckle 30 includes two elastic pieces 31 and an ending part 310 connected with the two elastic pieces 31. The ending part 310 is disposed between the three limiting pillars 12, thereby realizing the elastic buckle 30 fixed relatively to the housing 10.

The two electrodes 20 is configured for electrically connected with the power cord 101 such as a live cord, a zero cord. The electrical socket 100 can include another electrode which is connected with a ground cord.

The two electrodes 20 connected with the live cord and the zero cord are disposed in one side of the housing 10 and are separated from outer sides of two elastic pieces 31 of the elastic buckle 30. The first cover plate 40 covers the housing 10. Another electrode connected to the ground cord is disposed on the other side of the housing 10 and is covered by the second cover plate 60. It can be understood that the electrical socket 100 is further wrapped with an insulating plastic 102 on the periphery of the housing 10, the second cover plate 60, and the first cover plate 40, in order to fix the housing 10, the second cover plate 60 and the first cover plate 40. And the insulating plastic 102 wraps connection position of the power cord 101 and the three electrodes 20.

Figure 4:
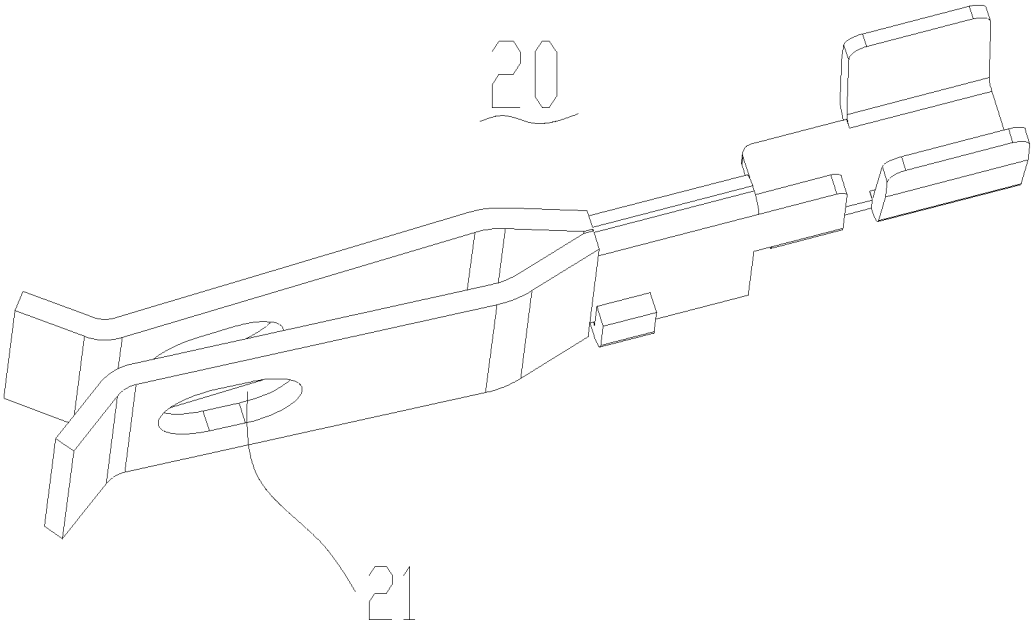
FIG. 4 is a perspective view of an electrode of the electrical socket of FIG. 1.

Referring to FIGS. 4 and 8, the two electrodes 20 for electrically connecting to the power cord 101 are respectively provided with through holes 21. Each of the two pins 201 of the electrical plug 200 are provided with a locking hole 202, which is matched with the through holes 21. When the pins 201 insert into the electrodes 20, the through holes 21 are placed coincidently with the locking holes 202. The through holes 21 and the locking holes 202 can have the same shape.

Referring to FIG. 5, the two elastic pieces 31 of the elastic buckle 30 are disposed opposite to each other. Each of the two elastic pieces 31 is respectively provided with a first peg 32 corresponding to the through hole 21. When the slider 50 is mounted on the first cover plate 40, a part of the slider 50 extends into the housing 10 and between the two elastic pieces 31 of the elastic buckle 30. The elastic buckle 30 can be made of plastic. The first peg 32 and the two elastic pieces 31 can be an integral structure. The first peg 32 can be made of plastic and have a certain rigidity. The first peg 32 can be a rigid structure. When the slider 50 is pushed, the two elastic pieces 31 of the elastic buckle 30 will be driven to open and the first peg 32 will insert into the through hole 21 for limiting pins 201 which is inserted in the electrodes 20, thereby realizing the locking function of the electrical socket 100 to the electrical plug 200.

When the first peg 32 inserts into the through hole 21 and the locking hole 202, the first peg 32 will abut to sidewall of the locking hole 202, in order to prevent the electrical plug 200 dropping out of the electrical socket 100.

Figure 7:
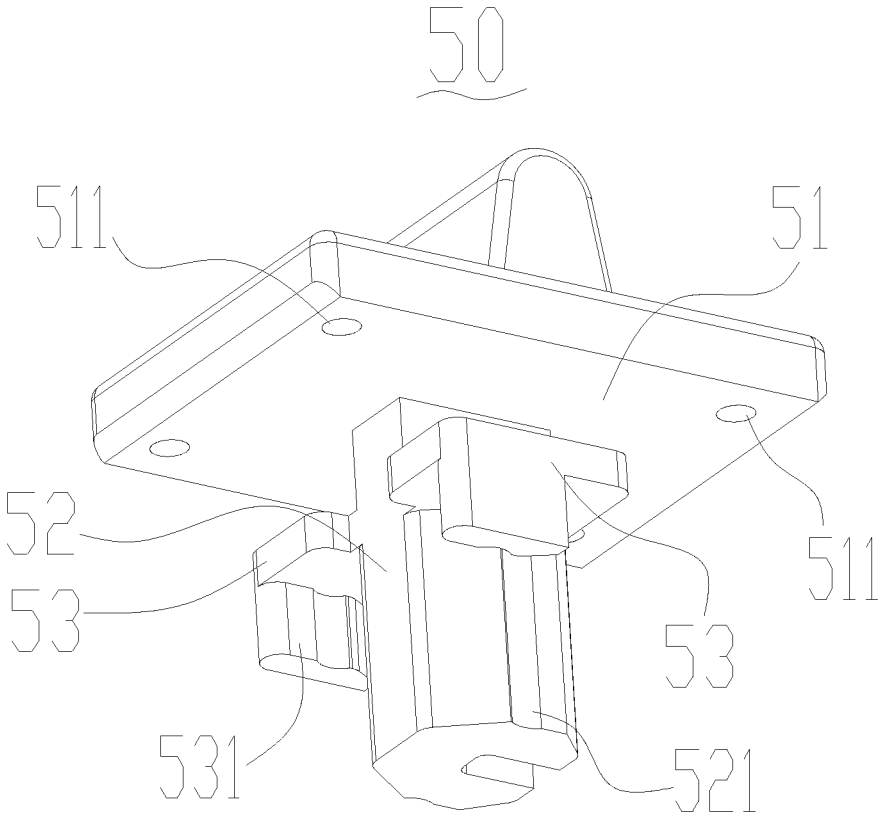
FIG. 7 is a perspective view of a slider of the electrical socket of FIG. 1.

Referring to FIGS. 6 and 7, the slider 50 includes a pushing plate 51 disposed on the first cover plate 40 and a pushing pillar 52 vertically connected with the pushing plate 51. A slot 43 is defined on the first cover plate 40. An end of the pushing pillar 52 away from the first cover plate 40 extends through the slot 43 and into the housing 10 and is located between the two elastic pieces 31 of the elastic buckle 30. When the pushing plate 51 is pushed, part of the pushing pillar 52 slides along the slot 43 and the end of the pushing pillar 52 will move until the two elastic pieces 31 are open.

Furthermore, a limiting portion 521 is disposed on each of opposite sides of the pushing pillar 52. Each of the two elastic pieces 31 is provided with a limiting mating portion 311. When pushing the slider 50, the pushing pillar 52 pushes the two elastic pieces 31 and the limiting portion 521 abuts the limiting mating portion 311 resulting in an increased distance between ends of the elastic pieces 31 and the first peg 32 inserts into the through hole 21. The limiting portion 521 and the limiting mating portion 311 can match to each other resulting in the limiting between the pushing pillar 52 and the two elastic pieces 31, in order to prevent the pushing pillar 52 from displacing under an elastic resilience force of the two elastic pieces 31.

Referring to FIGS. 5 and 7, the limiting portion 521 can include a concave surface. The limiting mating portion 311 can include a convex surface cooperating with the concave surface of the limiting portion 521. It can be understood that the limiting portion 521 can include a convex surface and the limiting mating portion 311 can include a concave surface, or the limiting portion 521 can be a ridge structure and the limiting mating portion 311 can be a groove structure, according to needs.

Referring to FIG. 7, a size of a part of the pushing pillar 52 closer to the ends of the elastic pieces 31 is larger than a size of the other part of the pushing pillar 52 away from the ends of the elastic pieces 31. It is easy to push the pushing pillar 52 and open the ends of the elastic pieces 31.

Referring to FIGS. 5 and 7, each of the two elastic pieces 31 is further respectively provided with a second peg 33. The second peg 33 can be disposed on a surface of the elastic pieces 31 toward the first cover plate 40. The pushing pillar 52 is further provided with two bending plates 53. The two bending plates 53 are disposed on opposite sides of the pushing pillar 52. When returning the slider 50, the limiting portion 521 moves away from the limiting mating portion 311 and the two bending plates 53 abuts the second peg 33, resulting in driving the elastic pieces 31 to return, the first peg 32 to drop out of the through hole 21 and the pins 201 to be released easily.

Each of the two bending plates 53 includes a cambered surface 531. The second peg 33 includes a mating surface 331 matching with the cambered surface 531. When the slider 50 is returned, the mating surface 331 of the second peg 33 abuts the cambered surface 531 of the two bending plates 53, resulting in the elastic pieces 31 returning.

Referring to FIGS. 6 and 7, the pushing plate 51 is provided with a sliding limit element 511 on a surface facing the first cover plate 40. The first cover plate 40 is provided with a sliding mating element 42 matched with the sliding limit element to ensure the pushing plate 51 slidably couples with the first cover plate 40. The pushing plate 51 can be slidably pushed on the first cover plate 40 in both pushing the slider 50 and returning the slider 50. The engagement between the sliding limit element 511 and the sliding mating element 42 achieves a limit between the slider 50 and the first cover 40, thereby ensuring that the electrical socket 100 can be stably locked with the electrical plug 200.

In this embodiment, the sliding limit element 511 includes four concave surfaces, and the sliding mating element 42 includes four protrusions. When pushing the pushing plate 51, two of the four concave surfaces will match with two of the four protrusions, result in limiting push between the pushing plate 51 and the first cover plate 40. When returning the pushing plate 51, other two of the four concave surfaces will match with the other two of the four protrusions, resulting in limiting return between the pushing plate 51 and the first cover plate 40. When the concave surfaces are pushed in the protrusions, a prompt sound can be emitted to indicate the electrical plug 200 is locked or unlocked by the electrical socket 100. It will be understood that the sliding mating element 42 can be a concave surface and the sliding limit element 511 can be a protrusion.

The electrical socket 100 further includes a power light 70 disposed in the housing 10. The power light 70 is electrically connected with the electrodes 20. When the electrical socket 100 and the electrical plug 200 are electrically connected, the power light 70 can emit light, which serves as a reminder.

Referring to FIG. 3, the housing 10 is provided with a mounting bracket 13 at a position between the two electrodes 20. The power light 70 is disposed on the mounting bracket 13 and electrically connected to the two electrodes 20.

The electrical socket 100 of the present embodiment has following advantages. The pins 201 of the electrical plug 200 can insert into the electrical socket 100. When the electrical plug 200 needs to be locked, the slider 50 is pushed and the first peg 32 of the elastic buckle 30 will insert through the through holes 21 of electrodes and the locking holes 202 of the pins 201, so that the electrical plug 200 can be stably locked by the electrical socket 100. The operation thereof is simple and the electrical plug 200 cannot easily detach from the electrical socket 100.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

I claim:

1. An electrical socket, comprising:

a housing;

at least two electrodes disposed in the housing, wherein each of the at least two electrodes has a through hole;

an elastic buckle disposed in the housing and comprising two elastic pieces disposed oppositely, wherein each of the two elastic pieces comprises a first peg corresponding to the through hole;

a slider comprising a part extending into the housing between the two elastic pieces of the elastic buckle, wherein the slider is configured for pushing the two elastic pieces of the elastic buckle and driving the first peg into the through hole for limiting movement of pins of an electrical plug when inserted in the electrodes, the electrical socket further comprises a first cover plate mounted on the housing, wherein the slider further comprises a pushing plate disposed on the first cover plate and a pushing pillar extending away from the pushing plate into the housing between the two elastic pieces of the elastic buckle, each of the two elastic pieces further comprises a second peg, the pushing pillar comprises two bending plates, the two bending plates are disposed on opposite sides of the pushing pillar, and when returning the slider to an original position, the limiting portion moves away from the limiting mating portion and the two bending plates abut the second peg, resulting in driving the elastic pieces to return and the first peg to move out from the through hole to release the pins from the electrodes.

2. The electrical socket of claim 1, wherein a limiting portion is disposed on opposite sides of the pushing pillar, each of the two elastic pieces comprises a limiting mating portion, and when pushing the slider, the limiting portion abuts the limiting mating portion thereby increasing the distance between ends of the elastic pieces and causing the first peg to insert into the through hole.

3. The electrical socket of claim 2, wherein the limiting portion has a concave surface for mating with a convex surface of the limiting mating portion.

4. The electrical socket of claim 2, wherein a size of a part of the pushing pillar closer to the ends of the elastic pieces is larger than a size of the other part of the pushing pillar away from the ends of the elastic pieces.

5. The electrical socket of claim 1, wherein each of the two bending plates comprises a cambered surface, the second peg comprises a mating surface matching with the cambered surface, and when returning the slider, the mating surface of the second peg abuts the cambered surface of the two bending plates, causing the elastic pieces to return.

6. The electrical socket of claim 1, wherein the first cover plate comprises a slot, a part of the pushing pillar extends through the slot and slidable along the slot, and the two bending plates abuts the first cover plate.

7. The electrical socket of claim 1, wherein the pushing plate comprises a sliding limit element on a surface facing the first cover plate, and the first cover plate comprises a sliding mating element matched with the sliding limit element to ensure the pushing plate slidably couples with the first cover plate.

8. The electrical socket of claim 7, wherein the sliding limit element is concave and the sliding mating element is a protrusion.

9. The electrical socket of claim 7, wherein the sliding mating element is concave and the sliding limit element is a protrusion.

10. The electrical socket of claim 1, further comprising a power light electrically connected with the electrodes and disposed in the housing.

11. The electrical socket of claim 1, wherein the first peg is made of plastic.

* * * * *